US006062407A

United States Patent [19]

Moore

[11] Patent Number: 6,062,407

[45] **Date of Patent: *May 16, 2000**

[54] CENTRIFUGALLY LOADED SELF-SEALING INTEGRAL ONE-PIECE CAP/CLOSURE

[75] Inventor: Patrick Q. Moore, Gilroy, Calif.

[73] Assignee: Beckman Coulter, Inc., Fullerton, Calif.

[ * ] Notice: This patent is subject to a terminal disclaimer.

[21] Appl. No.: 09/045,389

[22] Filed: Mar. 20, 1998

Related U.S. Application Data

[63] Continuation-in-part of application No. 08/842,986, Apr. 25, 1997, Pat. No. 5,855,289.

[51] Int. Cl.[7] ..... B65D 53/00

[52] U.S. Cl. ..... 215/270; 215/271; 422/72; 422/99; 422/102

[58] Field of Search ..... 422/99, 100, 102, 422/72, 918; 215/270, 271, 307, 309, 352; 220/303, 304

[56] References Cited

U.S. PATENT DOCUMENTS

| | | | |
|---|---|---|---|
| 558,523 | 4/1896 | Rosedale . | |
| 4,007,848 | 2/1977 | Snyder | 215/307 |
| 4,065,018 | 12/1977 | Megowen et al. | 215/270 |
| 4,738,370 | 4/1988 | Urmston et al. | 215/307 |
| 4,747,502 | 5/1988 | Luenser | 215/307 |
| 5,325,977 | 7/1994 | Haynes et al. | 215/307 |
| 5,855,289 | 1/1999 | Moore | 215/270 |
| 5,899,349 | 5/1999 | Moore | 215/277 |

*Primary Examiner*—Robert J. Warden, Sr.
*Assistant Examiner*—Fariborz Moazzam
*Attorney, Agent, or Firm*—William H. May; Margaret A. Kivinski

[57] ABSTRACT

A capping and sealing assembly for a sample-holding centrifuge container which features a self-sealing lid that forms a fluid-tight seal in an opening of the canister with a predetermined amount of force, with the force being dependent upon the centrifugal load to which the capping assembly is subjected. The lid includes a cover portion and a peripheral member surrounding the cover portion and extending transverse thereto. The lid is disposed within an open end of the container, with the peripheral member having a frusto-conical surface that faces the container's wall. A gasket is disposed about the frusto-conical surface, forming a fluid-tight and air-tight seal with the cylindrical wall of the canister. The gasket is received in a channel formed into the frusto-conical surface. A region of the channel includes a vent slot to facilitate removal of the container from the canister. A plurality of arcuate ribs extend across the cover portion, between opposed areas of the peripheral member. Each of the ribs are adapted to flex, under centrifugal force, expanding the opposed areas outwardly. In this manner, the sealing force between the peripheral member and the wall is increased.

22 Claims, 9 Drawing Sheets

CENTRIFUGALLY LOADED SELF-SEALING INTEGRAL ONE-PIECE CAP/CLOSURE

CROSS REFERENCE

This is a continuation-in-part of application Ser. No. 08/842,986 filed Apr. 25, 1997, now issued U.S. Pat. No. 5,855,289.

TECHNICAL FIELD

The present invention pertains to the field of centrifugation. Specifically, the present invention pertains to an improved capping and sealing assembly for removable sample-holding containers employed in centrifuges.

BACKGROUND ART

Centrifuges are commonly used in medical and biological industries for separating and purifying materials of differing densities, such as viruses, bacteria, cells and proteins. A centrifuge includes a rotor and a container to support a sample undergoing centrifugation. The rotor is designed to hold the sample container while it spins up to tens of thousands of revolutions per minute. To avoid spillage, evaporation, or aerosoling of the sample, a cover is placed onto the container so as to provide a fluid-tight seal therebetween.

During centrifugation, hydrostatic pressure within the container can compromise the seal integrity of the covered container. The hydrostatic pressure may force the sample to pass between the cover and the receptacle. Avoiding this type of leakage poses a great challenge when designing centrifuge sample containers. The prior art is replete with differing designs for sample-holding containers from which inspiration may be drawn to provide improved sample-holding centrifuge containers.

U.S. Pat. No. 718,643 to Lees et al. discloses a sealing-jar for preserving articles of food, FIG. 1, including a body of a receptacle (a), a recess (b), a cover (c), a flat flange (d), a circular down-turned rib (e), and a rubber gasket (f). A seal is achieved by the gasket (f) fitting around the cover (c), beneath the flange (d), so as to bear against the recess (b), but this seal is easily compromised by centrifugal forces.

Australian Pat. No. 4247/26 to Lucke et al. discloses an apparatus for sealing bottles and jars, FIGS. 1–3, containing a domed disc stopper 8 having a downwardly projecting wall 9 near its outer edge. The wall 9 is inclined to match the seating 7 at the top of a rigid neck 5 of a jar or bottle. A rigid cap 12 has internal screw-threads 6 that are designed to thread onto the neck 5. A resilient ring 10 fits into an annular groove in the face of the stopper, col. 3 lines 4–8. The resilient ring 10 seats against the neck 5 by the cap 12 pressing against the stopper 8.

U.S. Pat. No. 3,924,772 to Magnani et al. discloses an airtight container cap, FIGS. 1–3, containing a ring-nut 1 have an upper circular hole 2, a slot 3 on the side surface thereof and threads 4; a jar 7 with a threaded neck 6; glass stopper 8 having one groove 9 in the upper portion a second groove 10 in the lower portion and a shoulder 12; and a circular gasket 11. The circular gasket 11 is positioned within groove 10 of the glass stopper 8. The glass stopper 8 is then mounted inside of ring-nut 1 through hole 2. Ring-nut 1 is then threaded onto the neck 6 of a jar 7, forming a hermetic seal.

U.S. Pat. No. 4,844,273 to Hawkins et al. discloses a closure with enhanced sealing for a container, FIGS. 1–3, comprising a container neck lip 30 and a cap 18 having an inner skirt 24, a top 20 and a depending coaxial outer skirt 22. The outer skirt has internal threads 26 for engaging the complementary external threads 28 of the container neck. The inner skirt 24 has an interference fit with the inside of the container neck lip 30, thus, forming one element of the enhanced seal. A bead 32 projects inwardly from the depending skirt 22 and provides the second element of the enhanced seal by maintaining peripheral contact against the outside of the container neck lip 30. An o-ring 34 is positioned between the outer and inner skirts, 22 and 24, respectively, and becomes compressed between the top 20 and the container lip 30 to maintain a hermetic seal while the cap 18 is threaded on the container neck 12. The rigid inner skirt firmly presses against the inside of lip 30 and co-acts with the inwardly directed bead 32 maintaining peripheral contact with the outside lip 30, which helps to maintain the hermetic seal by retaining the o-ring 34 in its compressed state.

U.S. Pat. No. 5,291,783 to Hall discloses a tube 10 for use in a fixed angle centrifuge rotor having indicia 20 thereon indicating the level to which the tube may be filled with liquid without risk of spillage due to meniscus re-orientating.

U.S. Pat. No. 5,325,977 to Haynes et al. discloses a vented closure for a capillary tube assembly 10. The assembly 10 includes a capillary tube 12 having a bore extending therethrough and a cap 14 slidably mounted to one end of the tube 12. The cap 14 includes an enlarged head 16 and a substantially cylindrical body 18. One or more vent grooves 20 are formed into the body which allows air to escape when the cap 14 is in a first slidable position. The groove 20 typically extends parallel to the longitudinal axis of the cylindrical body 18.

U.S. Pat. No. 5,458,252 discloses an invertible pressure-responsive sealing cap 1 for attachment to a container 2 having a mouth 4 with an outwardly facing threaded portion 12. The mouth 4 has an inner cylindrical sealing surface 6. The cap 1 has a threaded portion 3 disposed on a cap skirt 5, with the threaded portion 3 facing inwardly toward a cap axis 7. A central dome portion 9 is symmetrically disposed about the cap axis 7 and extends outwardly therefrom, terminating in an annular portion 11. The dome portion 9 is initially concave and extends into the mouth 4 of the container 2. The interface of the dome portion 9 and the annular portion 11 define a first flexure area 17. A sealing portion 13 is disposed about the annular portion 11, defining a second flexure area 21 thereat. The sealing portion 13 includes an outwardly facing cylindrical surface 23. In operation, the cap 1 is mated to the container 2 and pressure build-up therein causes the dome portion 9 to flatten, increasing the sealing force between the sealing surfaces 23 and 6. A drawback with the aforementioned containers is that the fluid-tight integrity of the seals is compromised by samples egressing therethrough during centrifugation, which has led to the development of seals which employ centrifugal force to drive a cap or plug against a container.

U.S. Pat. No. 5,127,895 to R. Pawlovich; U.S. Pat. No. 5,395,001 to P. Moore; U.S. Pat. No. 5,361,922 to P. Moore et al.; U.S. Pat. No. 4,304,356 to S. Chulay et al.; U.S. Pat. No. 4,290,550 to S. Chulay et al.; U.S. Pat. No. 4,080,175 to S. Chulay et al.; and U.S. Pat. No. 4,076,170 to S. Chulay et al. al., all assigned to the assignee of the present invention, disclose centrifuge containers which achieve a seal by having a cap or plug forced against a container under centrifugal force. In some of these patents, deformable o-rings are used as part of the seal mechanism. Tapered surfaces, annular ridges and annular grooves are all employed, as in U.S. Pat. No. 5,395,001, to achieve a sealed sample.

What is needed is a capping assembly for a sample-holding centrifuge container that maintains a fluid-tight seal during high-speed centrifugation, increasing the sealing force proportional to a centrifugal load to which the container is subjected.

It is also desirous that the capping assembly provide an air-tight seal with a centrifugation canister into which the centrifuge container is placed during a centrifugation run. The cap assembly should be able to release the seal upon completion of the run to allow easy removal of the centrifuge container from the centrifugation canister.

SUMMARY OF THE INVENTION

A capping assembly for a sample-holding centrifuge container features a self-sealing lid that seals an opening of the container with a predetermined amount of force, with the force being dependent upon the centrifugal load to which the capping assembly is subjected. The canister includes a closed end, an open end, disposed opposite to the closed end, and a cylindrical wall extending therebetween. The lid includes a cover portion and a peripheral member surrounding the cover portion and extending transverse thereto. The lid is disposed within the open end, with the peripheral member having a frusto-conical surface that faces the cylindrical wall. A channel or recess is formed into the frusto-conical surface into which a gasket is received to form a fluid-tight and air-tight seal with the cylindrical wall of the canister. The gasket channel includes a vent slot for releasing the seal upon completion of a centrifugation run. As used herein, a fluid-tight seal means that the seal is impervious to both liquid flow and air flow. A plurality of arcuate ribs extend across the cover portion. Each of the plurality of ribs is adapted to flex, under centrifugal load, expanding the peripheral member outwardly. In this manner, the sealing force between the peripheral member and the cylindrical wall is increased.

Preferably, the self-sealing lid is employed in a dual-vessel centrifuge container. In addition to the canister, the dual-vessel centrifuge container includes a receptacle having a tubular portion extending from a threaded neck portion, terminating in a closed nadir. The neck portion includes a plurality of threads and defines an open mouth. The peripheral member includes a threaded region which engages the plurality of threads of the neck portion. A sealing device, e.g., an o-ring or other type of elastomer or plastomeric material, is disposed between the second major side and the neck to form a fluid-tight and air-tight seal therebetween. The relative dimensions of the lid, canister and receptacle are chosen so that the receptacle fits within the canister. With the receptacle placed in the canister, the frusto-conical surface forms a fluid-tight and air-tight seal with the cylindrical wall and the tubular portion is spaced apart from the cylindrical wall, with the nadir being positioned proximate to, and spaced-apart from, the closed end.

It is preferred that the aforementioned sealing device include a stopper having first and second opposed major surfaces and a peripheral surface extending therebetween. An annular depending portion extends from the second major surface away from said first major surface, defining an annular flange and a shoulder therebetween. The depending portion is spaced-apart from the peripheral surface, defining an annular flange. An annular gasket is disposed about the shoulder, and the depending portion is adapted to fit within the mouth. In this fashion, the gasket rests against the neck. The second major side of the cover portion includes an annular contact area that extends away from the second major surface and coincides with the annular flange upon the lid being threaded onto the neck, with the remaining portion of the second major side being spaced apart from the first major surface.

Finally, the receptacle includes a first alignment mark and the lid includes a second alignment mark, with both of the alignment marks arranged so as to be axially aligned after a predetermined amount of rotational movement between threaded region and the neck. In this manner, the annular gasket is subjected to a preset amount of torque to ensure a fluid-tight and air-tight seal is present. In the preferred embodiment, the first alignment mark consists of a recess formed into the tubular wall so as to extend along a length thereof. In this design, the recess functions as a vent to allow fluid and air to move freely as the receptacle is being inserted or extracted from the canister. This prevents a vacuum, or positive pressure, from being present between the canister and the receptacle, thereby facilitating the canister's insertion to, or removal from, the receptacle.

BEST MODE FOR CARRYING OUT THE INVENTION

Figure 1:
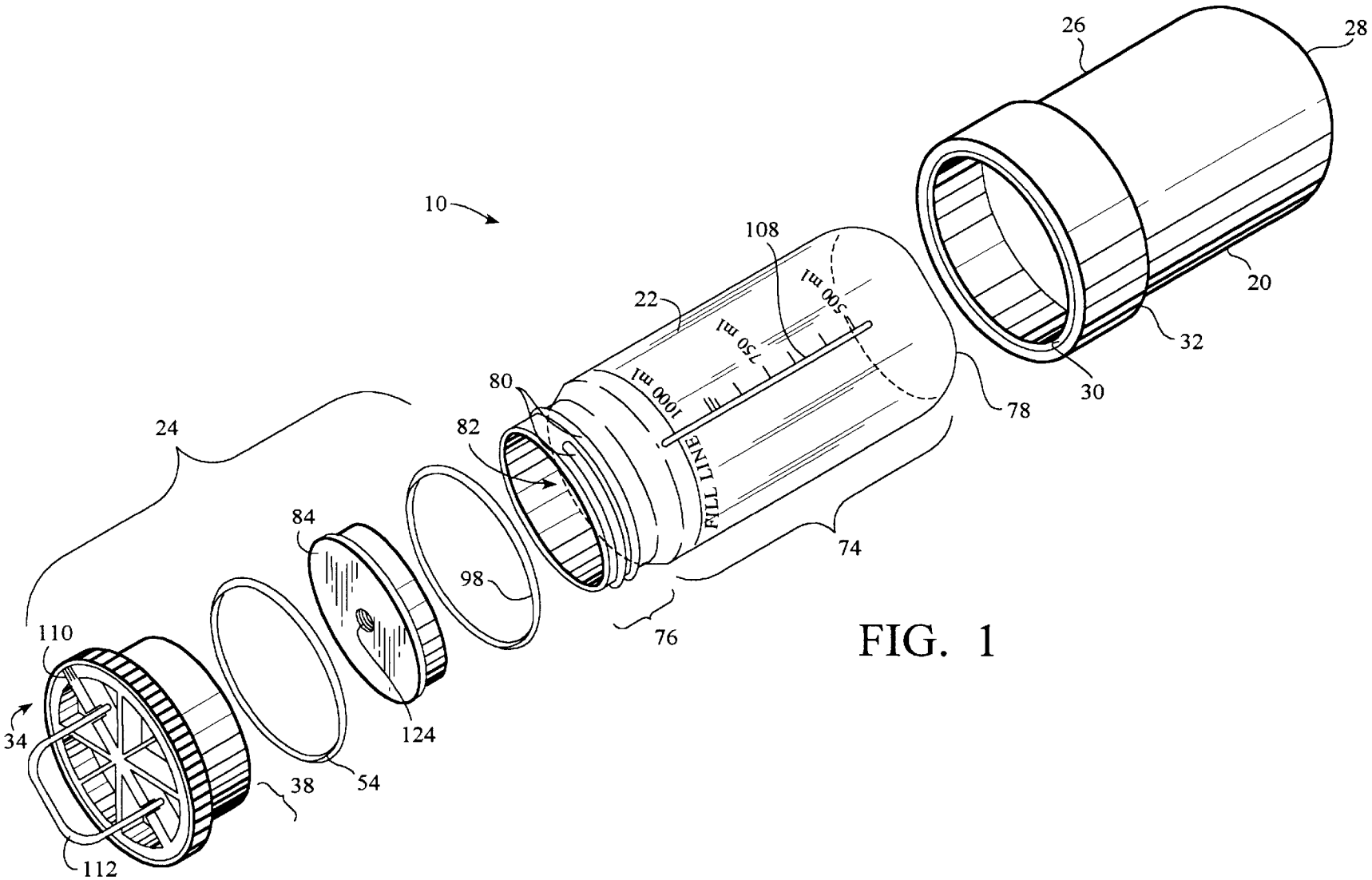
FIG. 1 is an exploded perspective view of the capping assembly employed in a dual-vessel removable sample-holding centrifuge container, in accord with the present invention.
Figure 2:
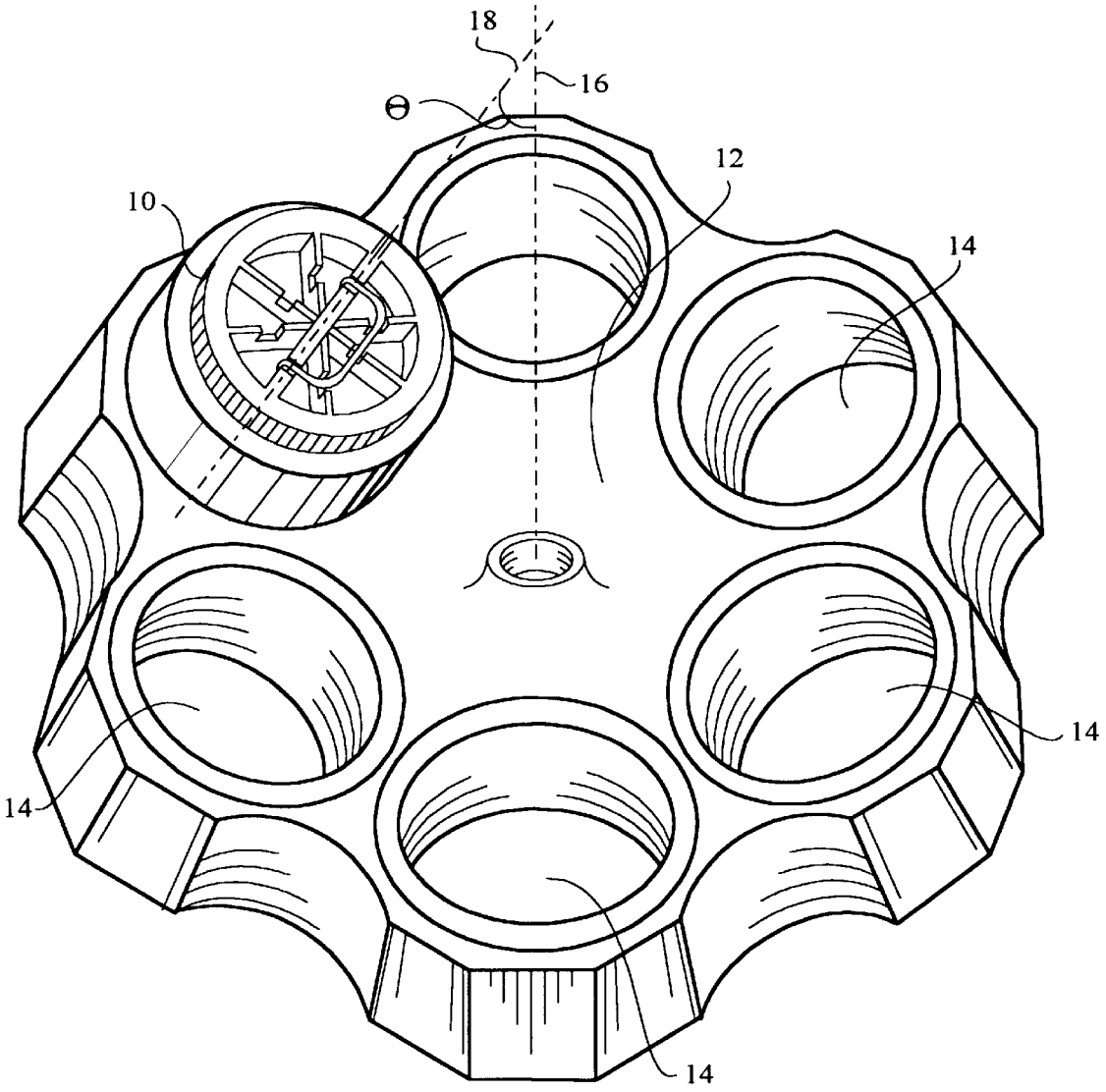
FIG. 2 is a perspective view showing a dual-vessel removable sample-holding centrifuge container of FIG. 1 placed in a centrifuge rotor, in accord with the present invention.

With reference to both FIGS. 1 and 2, a dual vessel centrifuge container 10 is shown for use in a fixed-angle centrifuge rotor 12 of the type having a plurality of bores 14 disposed radially symmetric about the rotor 12's spin axis 16. In fixed angle centrifuge rotor 12, a lengthwise axis 18 of the centrifuge container forms an angle Θ, with respect to the spin axis 16. The centrifuge container 10 includes a canister 20, a receptacle 22 and a capping assembly 24. The canister 20 may be permanently fixed to the rotor 12 or be removably attached thereto and have any cross-sectional area desired. For clarity, the canister 20 will be discussed as being removably attached to the rotor 12 and having a circular cross-sectional area defined by a cylindrical wall 26 that extends from a closed end 28, terminating in an open end 30. Protruding from the cylindrical wall 26, between the closed end 28 and the open end 30, is an annular shoulder 32. Each of the bores 14 are shaped to receive the canister 20 so that the shoulder 32 rests against the rotor 12.

Figure 3:
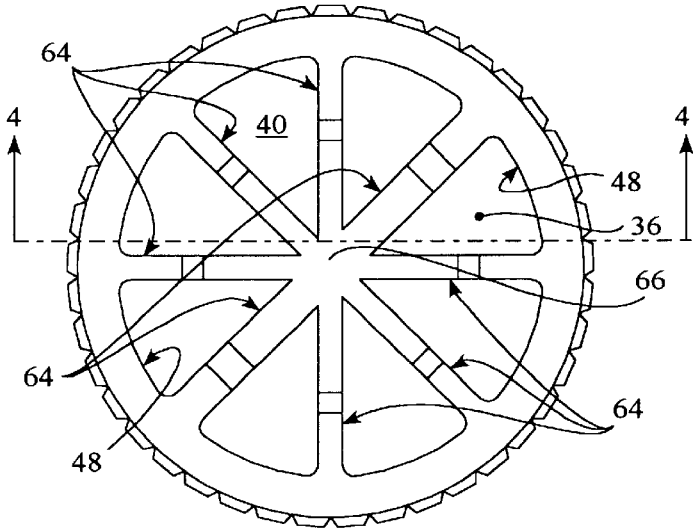
FIG. 3 is a top down view of a lid shown in FIG. 1.
Figure 4:
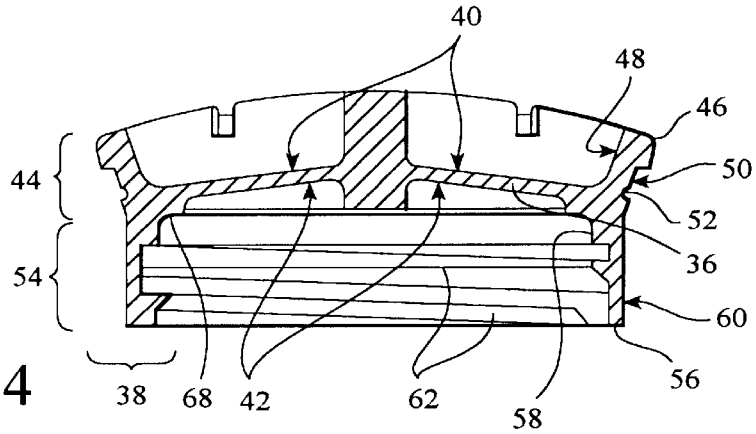
FIG. 4 is a cross-sectional view of the lid shown in FIG. 1, taken along lines 4—4.

Referring to FIGS. 1, 3 and 4, the capping assembly 24 includes a lid 34 having a cover portion 36 and a peripheral member 38, surrounding the cover portion 36 and extending transverse thereto. The cover portion 36 has first and second opposed major sides 40 and 42, respectively. The first side 40 has a convex shape, and the second side 42 has a concave shape. An upper portion (upper annular skirt) 44 of the peripheral member 38 extends away from the second side 42, terminating in an annular rim 46 positioned to face the first major side 40. The upper portion 44 includes an inner 48 surface and an outer surface 50, disposed opposite to the inner surface 48. The inner surface 48 extends between an upper surface of the annular rim 46 and the first side 40. The outer surface 50 extends from the annular rim 46 toward the second major side 42, terminating at an area of the peripheral member 38 that is positioned opposite to the cover portion 36. The outer surface 50 has a frusto-conical shape and includes an annular recess (gland) 52 to receive a gasket, e.g. o-ring 54. The annular rim 46 projects outwardly beyond the outer surface 50 and may be roughened or knurled to facilitate gripping the same. A lower portion 54 of the peripheral member 38 extends away from the upper portion 44, terminating in an annulus 56 which faces the second major side 42. The lower portion 54 includes inside and outside surfaces, 58 and 60, respectively. The inside surface 58 extends between the second side 42 and the annulus 56. The outside surface 60 is contiguous with the outer surface 50, extending between the annular recess 52 and the annulus 56. The lower portion 54 includes a plurality of threads 62 that are present on the inside surface 58. It is preferred, however, that the plurality of threads 62 be disposed on the inside surface 58.

Figure 5:
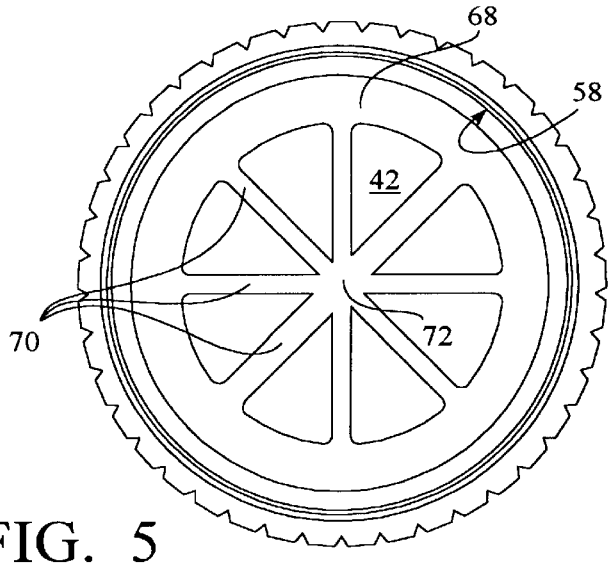
FIG. 5 is a bottom view of the lid shown in FIG. 3.

Referring to FIGS. 3 and 5, a first set of arcuate ribs 64 extend across the first side 40, following the contour thereof. Each of the ribs 64 traverse the extent of the cover portion 36 between opposed areas of the inner surface 48. The ribs 64 of the first set intersect proximate to a center of the cover portion 36, forming an apex 66 thereat. An annular contact ring 68 is disposed on the second major side 42 so as to be proximate to the inside surface 58 of the lower portion 54. A second set of ribs 70 extend across the second side 42, between opposed areas of the annular contact ring 68. The second set of ribs 70 are arcuate in that they follow the contour of the second side 42 and intersect proximate to a center of the cover portion 36, forming an apex 72 thereat. Each of the ribs 64 and 70 are adapted to flex, under a centrifugal load, expanding the peripheral member 38 outwardly, discussed more fully below.

Referring to FIGS. 1 and 4, the receptacle 22 may be formed of any polymeric material which can be molded to include a tubular portion 74 extending from a threaded neck portion 76, terminating in a closed nadir 78. The inside diameter of the tubular portion 74 varies along the length thereof, providing the inside surface of the tubular portion 74 with a gradual taper. Specifically, the inside diameter of the tubular portion 74 is smallest proximate to the neck portion 76 and gradually increases so as to be largest proximate to the nadir 78. This eases the removal of a sample therefrom by facilitating access thereto by a spatula (not shown) or other device. Compared to the remaining portions of the receptacle 22, the neck portion 76 is provided with increased wall thickness, and therefore, increased strength, due to the gradual taper of the inside surface. The neck portion 76 includes a plurality of threads 80 and defines an open mouth 82. The plurality of threads 62 are disposed on the inside surface 58 of the lower portion 54 and are adapted to engage the plurality of threads 80 of the neck portion 76. In this fashion, the lid 34 threadably engages the receptacle 22, with the second major side 42 being positioned adjacent to the neck portion 76 when placed in the final seating position. To obtain fluid-tight and air-tight integrity between the lid 34 and the receptacle 22, a sealing device is disposed between the second side 42 and the neck portion 76. Although any type of sealing device may be employed, e.g., an o-ring or other type of elastomer or plastomeric material, it is preferred that a stopper or plug 84 be employed, shown more clearly in FIG. 6.

Figure 6:
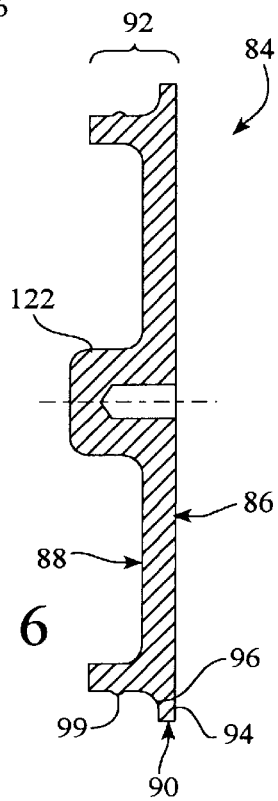
FIG. 6 is a cross-sectional view of a stopper or plug shown in FIG. 1.

Referring to FIGS. 1 and 6, the stopper 84 has a first major surface 86 and a second major surface 88, disposed opposite to the first major surface 86, as well as a peripheral surface 90 extending therebetween. An annular depending portion 92 extends from the second major surface 88, away from said first major surface 86. The depending portion 92 extends from an area of the second major surface 88 which is spaced-apart from the peripheral surface 90, defining an annular flange 94. An annular shoulder 96 is provided, between the annular flange 94 and the depending portion 92, to receive a gasket 98, such as an o-ring. To ensure that the gasket 98 is retained on the stopper 84, an annular protrusion 99 is formed on the depending portion 92.

Referring to FIGS. 1, 2, 7 and 8, in operation, the depending portion 92 of the stopper 84 is placed into the mouth 82 of the receptacle 22, and the lid 34 is threaded onto the neck portion 76, with the receptacle fitted into the canister 20 so that the frusto-conical surface 50 is seated against the cylindrical wall 26. To that end, the relative dimensions of the stopper 84 and the receptacle 22 are such that the depending portion 92 fits within the mouth 82. In this fashion, the gasket 98 is wedged against the neck portion 76, and the annular flange 94 approaches the upper edge 100 of the neck portion 76. To allow the gasket 98 to conform with the shape of the shoulder 96, while reducing the force necessitated to achieve the same, the neck portion 76 includes an arcuate gland 102. The arcuate gland 102 is formed into the neck portion 76 to extend from the upper edge 100, away from the plurality of threads 80. The shape of the gland 102 produces a rolling action, when the gasket 98 is compressed. The rolling action reduces the amount of force necessitated to distort and squeeze the gasket 98 into the appropriate shape to form a fluid-tight and air-tight seal between the stopper 84 and the receptacle 22. To facilitate the aforementioned compression, the annular contact ring 68 of the lid 34 is positioned to seat against the annular flange 94 of the stopper 84, directly above the gasket 98. The annular contact ring 68 is sized so as to extend toward the stopper 84 a further distance than the second set of ribs 72. In this fashion, the second set of ribs 72 are spaced apart from the first major surface 86, forming a void 106 therebetween.

As the rotor 12 rotates about its spin axis 16, the centrifuge container 10 is subjected to a centrifugal load, operating thereon in a direction parallel to the axis 18. The frusto-conical surface 50 allows the lid 34 and receptacle 22 to move toward the closed end 28 in response to the load, further tightening the seal between the gasket 54 and the cylindrical wall 26. To facilitate this movement, the tubular portion 74 is in slidable engagement with the cylindrical wall 26, and the nadir 78 is spaced-apart from the closed end 28, when placed in the final seating position and the rotor 12 is at rest. The fluid-tight and air-tight seal formed between the gasket 54 and the cylindrical wall 26 prevents leakage of a sample or air from the canister 20, were the receptacle 22 to rupture or otherwise allow the sample to egress therefrom. A further advantage provided by the lid 34 is that the ribs 64 and 70, disposed thereon, amplify said force in response to centrifugal loading. Specifically, the ribs 64 and 70 are adapted to flex under centrifugal load, causing the apexes 66 and 72 to move toward the first major surface 86. The movement of the apexes 66 and 72 expands the circumference of the upper portion 44 of the peripheral member 38.

Figure 9:
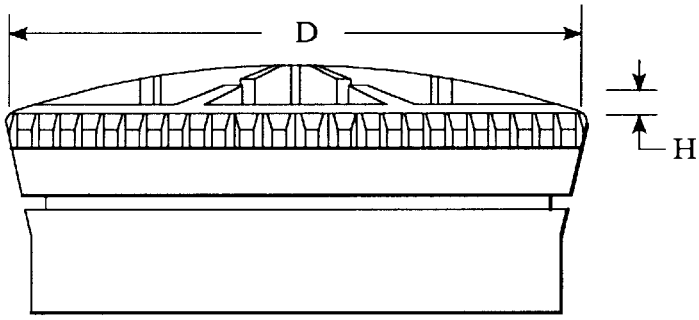
FIG. 9 is a side view of the lid shown in FIG. 3 when at rest.
Figure 10:
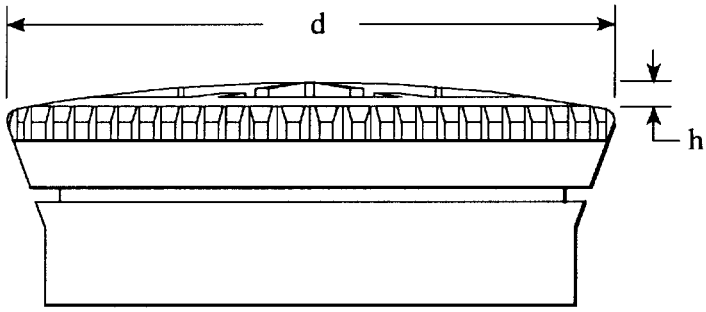
FIG. 10 is the lid shown in FIG. 9 when subjected to centrifugal loading.

FIGS. 9 and 10 demonstrate the expansion of the circumference of the upper portion 44 of the peripheral member 38. The static dimensions of the lid 34 are shown in FIG. 9, when the rotor (not shown) is at rest, with the diameter of the of the peripheral member 38 being shown as D and the height of the apex 66 above the annular rim 46 shown as H. As shown in FIG. 10, during centrifugation, height of the apex 66 above the annular rim 46 changes as a result of the centrifugal load, discussed above, so as to measure a distance h, with h<H. The aforementioned change in height results from the deflection of ribs 64 and 70. The deflection is in the range of 0.0010 to 0.0045 inch, depending upon the rotational speed of the rotor and the rotor's size. The aforementioned deflection causes a proportional change in the diameter of the peripheral member. As shown, under a centrifugal load, the diameter of the peripheral member 38 measures a distance d, with d>D. This results in an increase in the sealing force applied by the lid 34 that is proportional to the centrifugal load to which the lid 34 is subjected.

Referring again to FIGS. 2, 7 and 8, the first and second sets of ribs 64 and 70, however, provide a sufficient amount of resistance to the centrifugal load to maintain the void 106 between the second set of ribs 70 and the first major side 86. This focuses the compressive force applied by the lid 34 onto the area of the stopper 84 which coincides with the annular ring 68. It was discovered that compressive forces applied to the center of the stopper 84 caused the seal, formed between the gland 102 and the gasket 98, to fail. Focusing the compressive force applied by the lid 34, as discussed above, avoids this problem.

Figure 8:
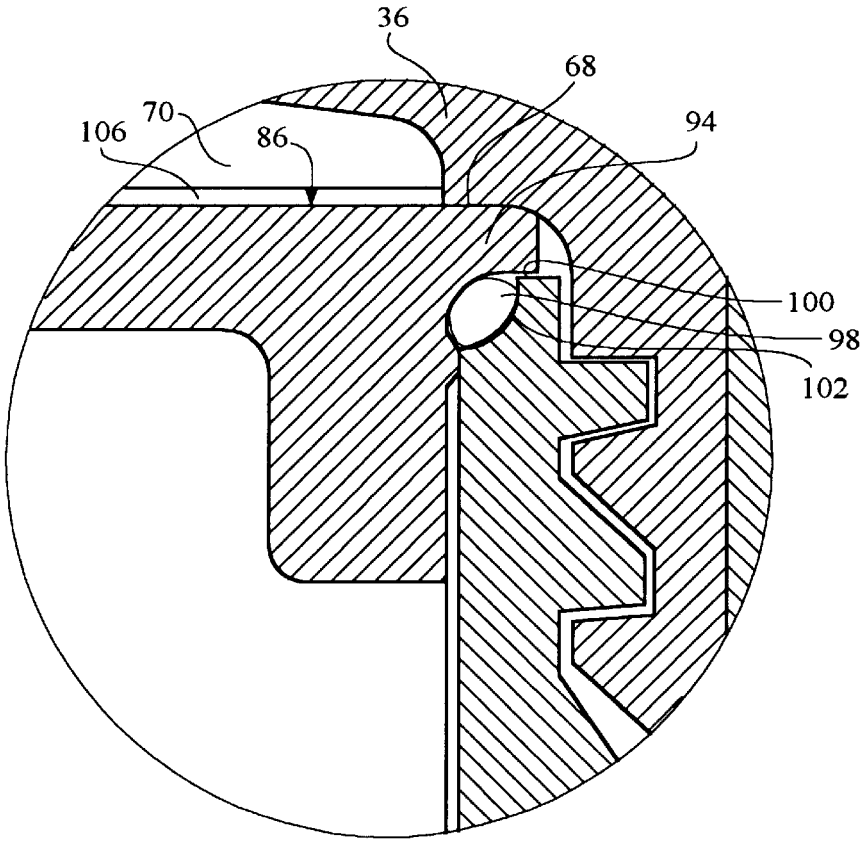
FIG. 8 is a detailed view of the container shown in FIG. 7.

Referring to FIGS. 1 and 8, to achieve a fluid-tight and air-tight seal between the gasket 98 and the gland 102, the receptacle 22 includes a first alignment mark 108, and the lid 34 includes a second alignment mark 110. Both the first and second alignment marks 108 and 110 are arranged so as to be axially aligned after a predetermined amount of rotational movement between the lid 34 and the receptacle 22. Although the alignment marks 108 and 110 may be indicia, in the preferred embodiment, the first alignment mark 108 consists of a recess formed into the tubular wall 74 so as to extend along a length thereof. In this design, the recess functions as a vent to allow fluid to move freely as the receptacle is being placed in, or removed from, the canister 20. This prevents a vacuum, or positive pressure, from being present between the canister 20 and the receptacle 22, thereby facilitating coupling and decoupling of the same. The second alignment mark 110 is typically a detent.

Figure 7:
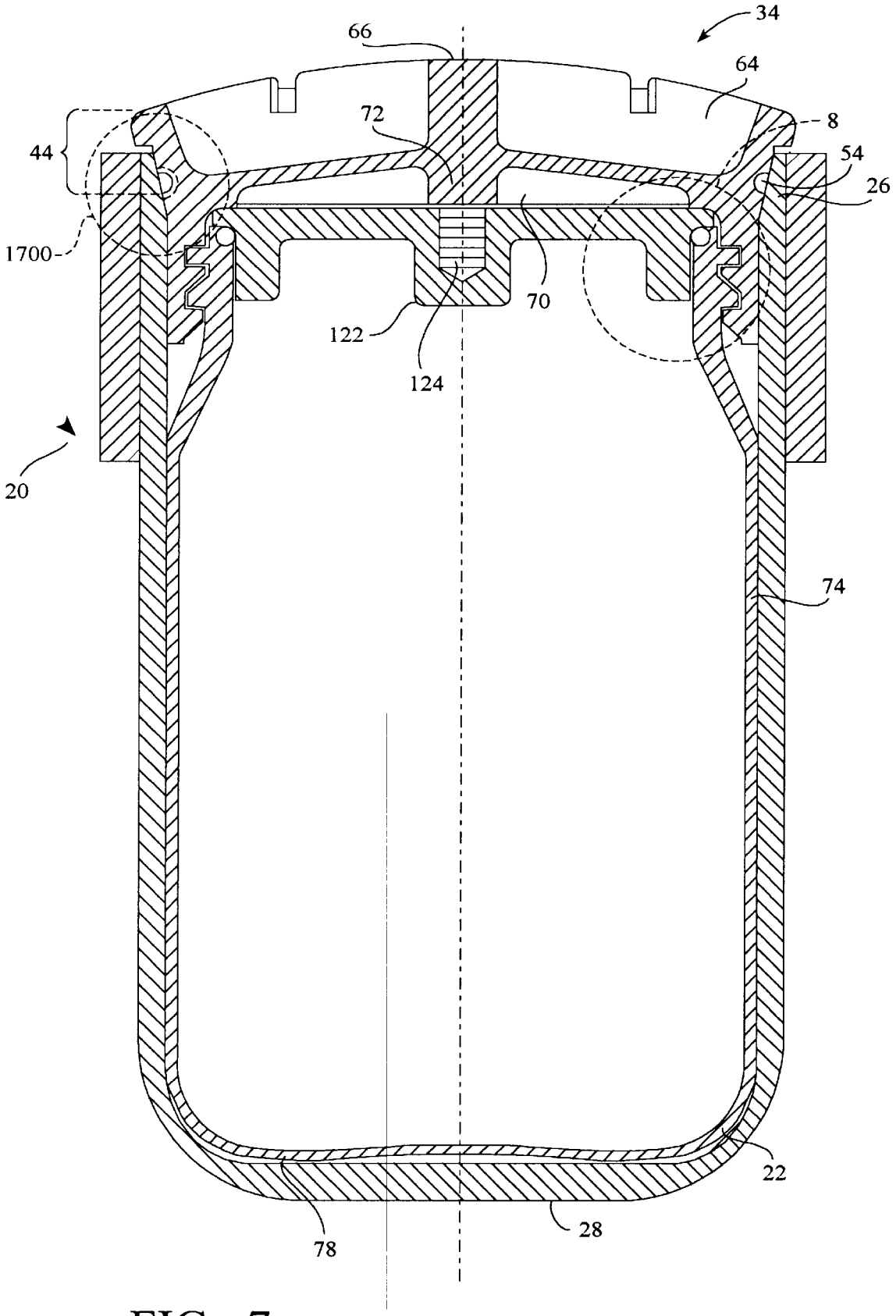
FIG. 7 is a cross-sectional view of the container shown in FIG. 1, with the capping assembly shown in a final seating position.
Figure 11:
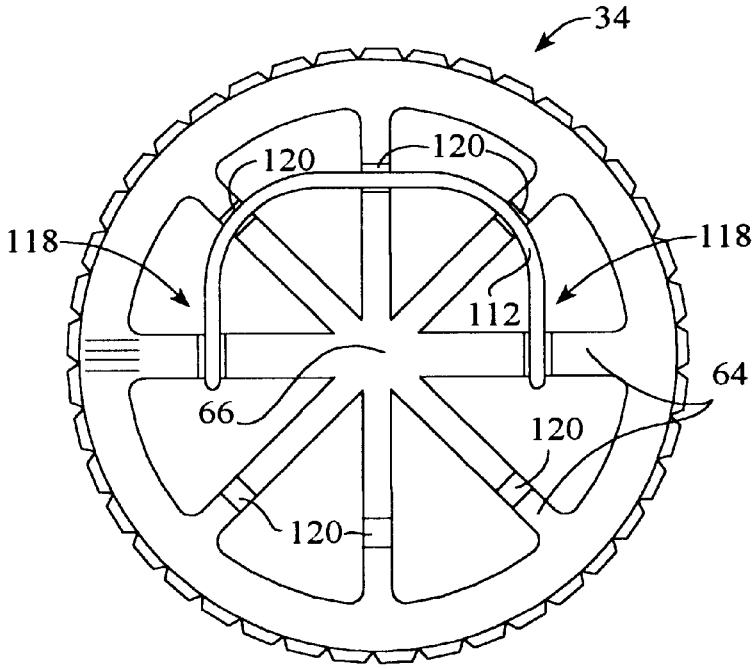
FIG. 11 is a top down view of the lid shown in FIG. 3, having a handle disposed thereon.
Figure 12:
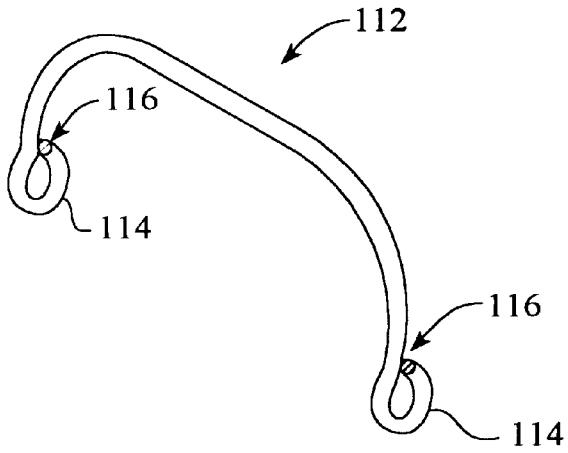
FIG. 12 is perspective view of the handle shown in FIG. 11.

Referring to FIGS. 1, 11 and 12, additional features may be provided to facilitate coupling and decoupling of the various components of the dual vessel centrifuge container 10. For example, the lid 34 may include curved handle 112, the opposed ends of which are attached to one of the ribs 64 on opposing sides of the apex 66. The opposed ends may include circular loops 114 having a gap 116 present therein. One of the ribs 64 may include through-ways 118 in which one of the circular loops 114 is disposed. This allows the handle 112 to be rotatably attached to the lid 34, which facilitates placing the handle adjacent to the ribs 64 when not in use, shown in FIG. 11. To further reduce the drag that the handle 112 may create during centrifugation, a slot 120 may be formed into each rib 64 so as to receive the handle when placed adjacent thereto. The slots 120 may be of sufficient depth to allow the handle 112 to be disposed between the apex 66 and the annular ring 46. In addition, the flexibility of the ribs 64 and 70, shown more clearly in FIGS. 3 and 4, may be augmented by increasing either the number or the size of the slots 120, present therein. Finally, as shown in FIGS. 6 and 7, the stopper 84 may include a centrally located boss 122 having a threaded bore 124. This allows a threaded removal device (not shown) to be employed to remove the stopper 84 from the receptacle 22.

Figure 13A:
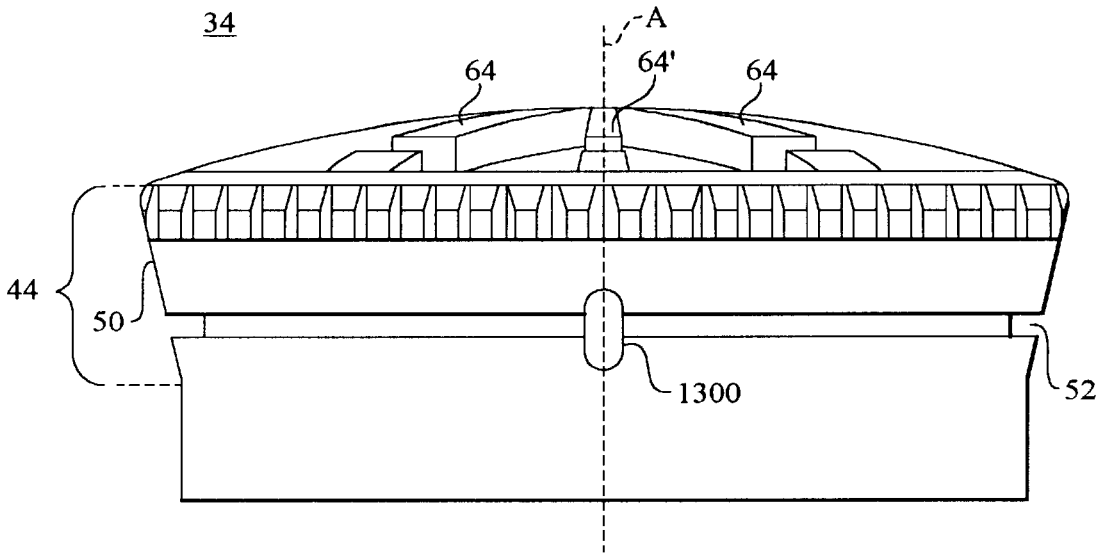
FIGS. 13A and 13B show various embodiments of the vent slot feature of the present invention.
Figure 14A:
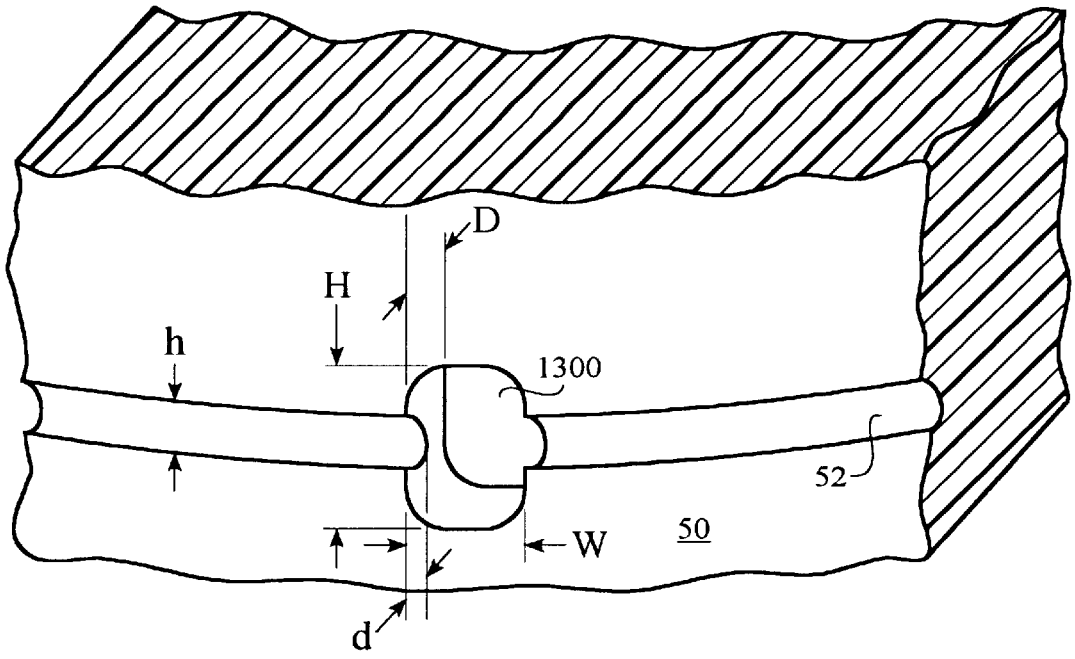
FIGS. 14A and 14B show magnified views of the vent slot feature.

Referring to FIGS. 7, 13A, 14A, and 14B, another aspect of the present invention is shown. In FIG. 13A, lid 34 is shown with annular recessed channel (gland) 52 formed into the exterior surface 50 of upper skirt portion 44. A vent slot 1300 is formed into a region of recessed channel 52. FIG. 14A illustrates a magnified perspective view of this region, showing in exaggerated detail the features of vent slot 1300 in accordance with the invention.

Figure 14B:
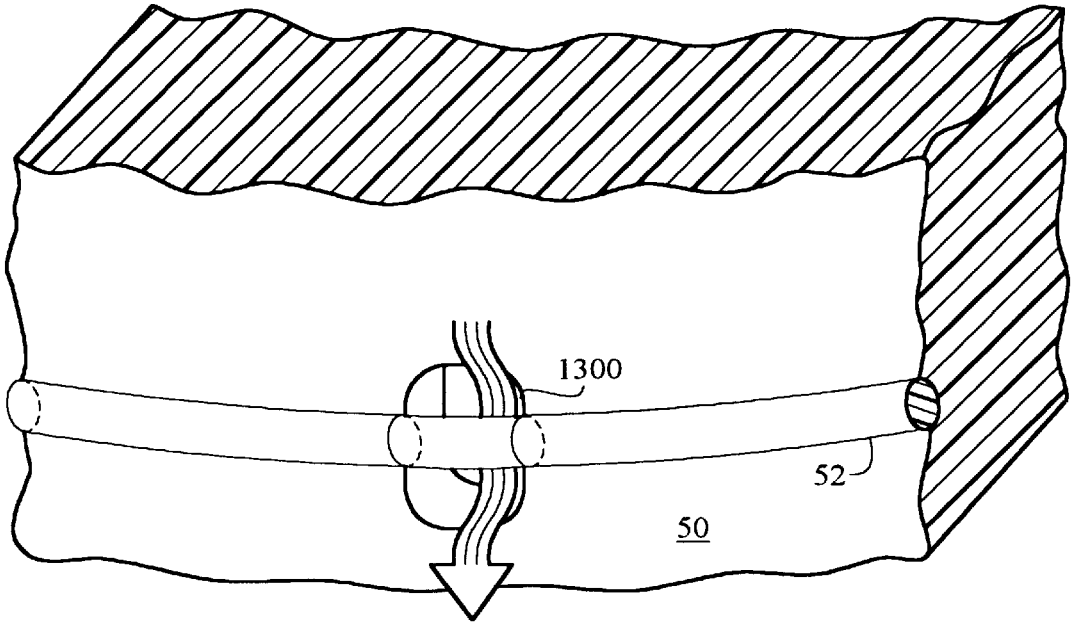
Figure 15:
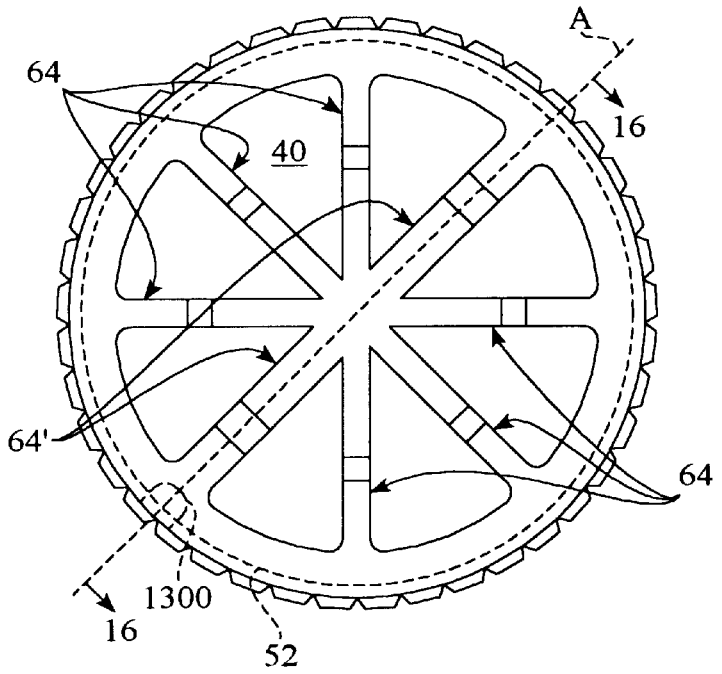
FIG. 15 is a top view of the lid, showing the relative positions of the recessed channel and the vent slot.
Figure 16:
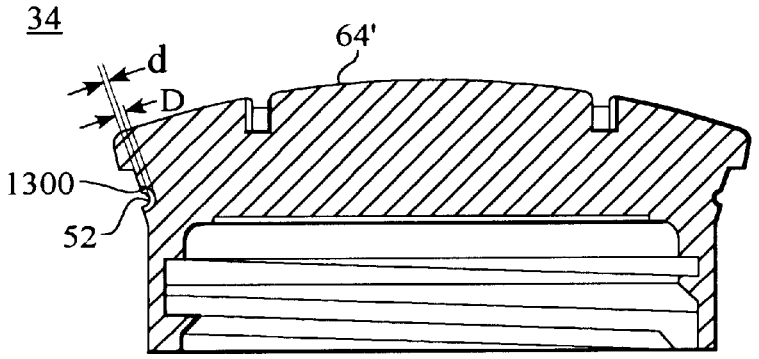
FIG. 16 is a cross-sectional view taken from the view line shown in FIG. 15.

The channel 52 can be thought of as having two regions: the first region comprising that part of the channel which circles the exterior surface of the upper portion 44 of the lid; and the second region comprising that part of the channel having the vent slot 1300. The height measurement h of the channel is substantially constant throughout the first region. Similarly, the depth measurement d of the channel is substantially constant in the first region. The channel in the second region has increased dimensions, thus defining the vent slot 1300. The vent slot 1300 has a height measurement H that is greater than the channel height h in the first region and a depth measurement D that is greater than the corresponding depth measurement of the channel in the first region. In a preferred embodiment, vent slot 1300 has a depth D that is on the order of 1%–5% deeper than the depth of the channel. FIG. 14B shows the inclusion of an O-ring 54 received in recessed channel 52. FIGS. 15 and 16 provide alternate views, showing the position of the vent slot 1300 relative to the recessed channel 52.

As shown in FIG. 13A, vent slot 1300 is aligned with rib 64'. Since the removal of material to form vent slot 1300 has the effect of reducing the structural integrity of the lid, alignment of the vent slot with a rib is preferred in order to minimize such an effect. For similar reasons, the vent slot is positioned symmetrically about an axis A passing through rib 64'.

Figure 13B:
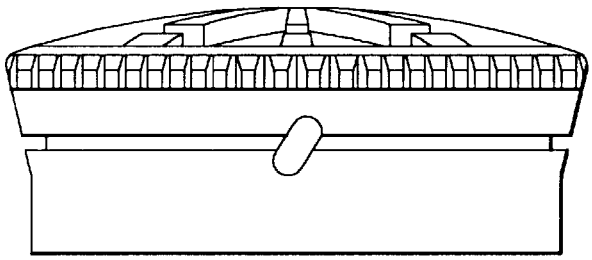

FIG. 13B shows an alternate embodiment of the vent slot. It differs in the shape of the opening into the slot. Whereas FIG. 13A shows a vertically oriented elongate vent slot, the slot can have an off-axis opening such as shown in FIG. 13B.

Figure 17:
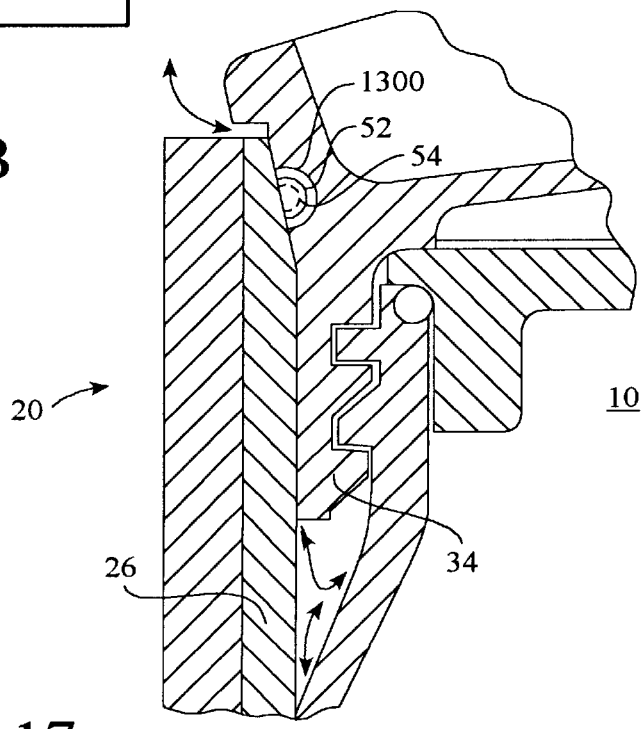
FIG. 17 is an enlarged view of a region identified as region 1700 in FIG. 7.

Referring to FIG. 17, which is an enlarged region of region 1700 shown in FIG. 7, the possibility of fluid loss or loss of atmospheric integrity can occur between the lid 34 and the wall 26 of the canister 20 during centrifugation via the fluid paths indicated by the arrows. The purpose of the O-ring gasket 54 is to prevent such losses. However, subsequent to a centrifugation run, the internal atmosphere between the centrifuge container 10 and the canister 20 can be much lower than the outside atmosphere thus making removal of the container 10 quite difficult, oftentimes requiring the use of special tools. The vent slot 1300 alleviates this problem by allowing the internal atmosphere to equalize with the external atmosphere after centrifugal load is removed. Under centrifugal loading, the vent slot permits a reliable canister seal to form.

Under static conditions, when there is no centrifugal loading, the O-ring 54 is in its relaxed state and does not close off the vent slot. Referring to FIG. 14B, this permits a flow of air (as indicated by the arrow) via the interior region of the vent slot, in effect bypassing the O-ring. However, under centrifugal loading during a centrifugation run, the O-ring is subjected to a compressive load and conforms to the entire internal surface comprising recessed channel 52. In addition, the portion of the O-ring located at vent slot 1300 extrudes into the vent slot, thus closing off the cavity in the vent slot to create a complete seal between canister 10 and container 20. When the compressive force is removed by removal of the centrifugal load, the O-ring contracts and pulls back out of vent slot 1300. This opens up the cavity in the vent slot so that venting can occur. Thus, if a vacuum is present in the canister, due to improperly machined components or damage from misuse for example, it will be relieved by virtue of air flowing from the external atmosphere through the cavity of the vent slot and into the space between canister 10 and container 20.

Preferably, the shape of the opening of the vent slot is a vertical elongate opening such as shown in FIG. 13A. It has the advantage of having minimum impact on the structural integrity of the cap and still permits affective occlusion of the vent slot by the o-ring during centrifugation. However, depending on the materials used, alternate shapes can be arrived at without undue experimentation and perform with equal effectiveness without departing from the scope and spirit of the present invention.

I claim:

1. A cap apparatus for a centrifuge container, comprising:

a lid having an upper surface and a bottom surface, said bottom surface having a lower annular skirt depending therefrom, said lower skirt having an exterior surface, said exterior surface having a gland formed thereinto for receiving a gasket, said exterior surface further having a vent slot formed thereinto and coincident with a first location along said gland.

2. The cap apparatus of claim 1 wherein said vent slot has a height greater than a height of said gland at said first location.

3. The cap apparatus of claim 1 wherein said vent slot has a depth from said exterior surface that is greater than a depth of said gland at said first location.

4. The cap apparatus of claim 1 wherein said vent slot has a longitudinal axis that is non-collinear with a longitudinal axis of said gland at said first location.

5. The cap apparatus of claim 1 wherein said upper surface of said lid includes a plurality of first ribs, each first rib spanning a diameter of said lid.

6. The cap apparatus of claim 5 wherein said first location is aligned with one of said first ribs.

7. The cap apparatus of claim 6 wherein said vent slot is symmetric about an axis of said one of said first ribs.

8. The cap apparatus of claim 5 wherein said bottom surface of said lid includes a plurality of second ribs, each second rib spanning a diameter of said lid.

9. The cap apparatus of claim 8 further including a stopper member having a protruding portion and a flange formed therearound, said bottom surface of said lid further having an annular contact surface disposed upon a periphery thereof, whereby said stopper is received within a mouth of said centrifuge container and said contact surface of said lid presses said flange against an upper edge of said mouth upon assembling said cap apparatus to said centrifuge container.

10. A cap apparatus for a centrifuge container, comprising:

a lid member having a cover portion;

said cover portion having opposed upper and bottom surfaces, said upper surface having a generally convex shape, said bottom surface having a generally concave shape;

said cover portion having a rim disposed about the periphery thereof, said rim extending above said upper surface and below said bottom surface;

said cover portion having a plurality of first ribs, each first rib disposed upon said upper surface and spanning a first diameter of said rim;

said cover portion having a plurality of second ribs, each second rib disposed upon said bottom surface and spanning a second diameter of said rim.

11. The cap apparatus of claim 10 further including a stopper member having a protruding portion and a flange formed therearound, said cover portion having an annular contact surface disposed upon a periphery of said bottom surface, whereby said stopper is received within a mouth of said centrifuge container and said contact surface presses said flange against an upper edge of said mouth upon assembling said cap apparatus to said centrifuge container.

12. The cap apparatus of claim 11 further including a gasket disposed about said protruding portion of said stopper member, whereby assembly of said cap apparatus to said centrifuge container causes said gasket to press against said flange thus forming an airtight seal between said stopper member and said upper edge of said mouth of said centrifuge container during centrifugation of said centrifuge container.

13. The cap apparatus of claim 10 further including a circumferential recess formed into the outer surface of said rim for receiving a gasket and a vent slot formed into the outer surface of said rim at a first location along said circumferential recess.

14. The cap apparatus of claim 13 wherein said vent slot has a depth greater than the depth of said circumferential recess at said first location.

15. The cap apparatus of claim 13 wherein said vent slot has height greater than the height of said circumferential recess at said first location.

16. The cap apparatus of claim 13 wherein said first location is aligned with one of said first ribs and said vent slot is symmetric about an axis of said one of said first ribs.

17. The cap apparatus of claim 13 wherein said vent slot has a longitudinal axis that is skewed relative to an axis of said circumferential recess at said first location.

18. The cap apparatus of claim 13 wherein said rim includes a frustum-shaped portion, said circumferential recess being disposed in said frustum-shaped portion of said rim.

19. In a centrifuge container which is received in a canister for centrifugation, a cap assembly for said centrifuge container comprising:

a lid having a cap, said cap having a convex-shaped upper surface and a concave-shaped bottom surface, said upper surface having a plurality of first diametrically spanning ribs disposed thereupon, said cap having an annular member extending downwardly from the periphery of said cap;

said annular member having a channel circumferentially formed into an exterior surface thereof for receiving a gasket, said channel having at least a first region and a second region;

said first region having substantially constant height and depth measurements;

said second region having height and depth measurements that are greater than the corresponding measurements of said first region.

20. The cap assembly of claim 19 wherein said second region is aligned with one of said first ribs.

21. The cap assembly of claim 19 wherein said second region has an opening that is rectilinear in shape.

22. The cap assembly of claim 19 wherein said second region has an opening that is rectilinear; a long axis of said opening being skewed relative to an axis along said channel.

* * * * *